US005711116A

United States Patent [19]

Hasan

[11] Patent Number: 5,711,116

[45] Date of Patent: Jan. 27, 1998

[54] POLYMER BATTEN WITH ADHESIVE BACKING

[75] Inventor: Riaz-Ul S. Hasan, Palatine, Ill.

[73] Assignee: Illinois Tool Works Inc., Glenview, Ill.

[21] Appl. No.: 515,033

[22] Filed: Aug. 14, 1995

Related U.S. Application Data

[63] Continuation-in-part of Ser. No. 208,247, Mar. 9, 1994, Pat. No. 5,469,671, which is a continuation of Ser. No. 831,412, Feb. 5, 1992, Pat. No. 5,309,685.

[51] Int. Cl.[6] ..... E04D 1/36

[52] U.S. Cl. ..... 52/58; 52/410; 428/189; 428/906

[58] Field of Search ..... 52/58, 404, 408, 52/410, 698; 428/137, 189, DIG. 906; 156/71, 92

[56] References Cited

U.S. PATENT DOCUMENTS

| | | | |
|---|---|---|---|
| 3,900,102 | 8/1975 | Hurst | 206/411 |
| 3,937,640 | 2/1976 | Tajima et al. | 156/71 |
| 4,068,027 | 1/1978 | Van Ornum | 428/35 |
| 4,113,799 | 9/1978 | Van Ornum et al. | 260/876 |
| 4,426,468 | 1/1984 | Ornum et al. | 523/166 |
| 4,539,344 | 9/1985 | Ornum et al. | 523/166 |
| 4,584,153 | 4/1986 | Bacon | 264/169 |
| 4,588,637 | 5/1986 | Chiu | 428/355 |
| 4,642,256 | 2/1987 | Sato | 428/42 |
| 4,670,071 | 6/1987 | Cooper et al. | 156/71 |
| 4,712,348 | 12/1987 | Triplett et al. | 52/408 |
| 4,793,116 | 12/1988 | Whitman | 52/173 |
| 4,803,111 | 2/1989 | Mansell | 428/139 |
| 4,855,172 | 8/1989 | Chiu | 428/57 |
| 4,885,887 | 12/1989 | Simmons et al. | 52/410 |
| 4,932,171 | 6/1990 | Beattie | 52/58 |
| 4,937,990 | 7/1990 | Paquette | 52/199 |
| 4,963,430 | 10/1990 | Kish et al. | 428/220 |
| 5,000,361 | 3/1991 | Briddell et al. | 222/575 |
| 5,000,999 | 3/1991 | Hollander | 428/137 |
| 5,088,259 | 2/1992 | Myers | 52/410 |
| 5,309,685 | 5/1994 | Rathgeber et al. . | |

FOREIGN PATENT DOCUMENTS

| | | | |
|---|---|---|---|
| 871960 | 6/1971 | Canada | 20/50 |
| 1174024 | 9/1984 | Canada | 20/20.2 |

*Primary Examiner*—Lanna Mai
*Attorney, Agent, or Firm*—Schwartz & Weinrieb

[57] ABSTRACT

A self-contained composite roofing batten bar has a layer of adhesive material secured to the bottom or undersurface portion of a roofing batten bar or strip. The adhesive material is tacky or sticky at room temperature and preferably comprises a butyl rubber composition. In view of the inherent tackiness or stickiness of the butyl rubber adhesive composition, one surface of the adhesive material layer is inherently adhered to the bottom or undersurface portion of the roofing batten bar or strip, and the other lower or undersurface portion of the adhesive layer is covered by a releasable paper backing strip. When it is desired to use the composite batten bar in order to secure, for example, a roofing membrane to underlying roofing structure, the releasably paper backing strip is simply removed thereby exposing the lower or undersurface portion of the adhesive layer. The batten bar or strip is then able to be mounted upon or atop the roofing membrane at predetermined locations as dictated by the overall roofing installation requirements. The batten bar or strip may be provided with preformed apertures or holes for the reception of suitable fasteners such that the batten bar and roofing membrane assembly may be fixedly secured to the underlying roofing structure or decking.

20 Claims, 3 Drawing Sheets

POLYMER BATTEN WITH ADHESIVE BACKING

CROSS-REFERENCE TO RELATED PATENT APPLICATIONS

This patent application is a Continuation-In-Part (CIP) patent application of U.S. patent application Ser. No. 08/208,247, filed on Mar. 9, 1994 in the name of Juergen O. Rathgeber and entitled ROOF PERIMETER COMPOSITE SECURING ELEMENT AND METHOD OF INSTALLING, now U.S. Pat. No. 5,469,671 which in turn, is a continuation patent application of U.S. patent application Ser. No. 07/831,412, filed on Feb. 5, 1992 in the name of Juergen O. Rathgeber and entitled ROOF PERIMETER COMPOSITE SECURING ELEMENT AND METHOD OF INSTALLING, and which is now U.S. Pat. No. 5,309,685.

FIELD OF THE INVENTION

The present invention relates generally to roofing battens and more particularly to a new and improved composite roofing batten which has an adhesive backing layer already applied thereto.

BACKGROUND OF THE INVENTION

Various different types of roofing battens, roofing systems, and composite roofing batten fastening systems are of course well-known. One type of prior art or conventional roofing system is disclosed within FIG. 1 of the drawings, and as more fully decribed within the aforenoted patent and patent application, such a system briefly comprises a roofing structure or deck 10 having a parapet wall 12 defining a perimeter portion of the roof. The roofing deck 10 is covered by means of a layer or slab of insulation 14, and a perimeter membrane 16 is disposed atop the insulation 14 at a position adjacent to the wall 12 such that one longitudinal edge of the membrane 16 abuts wall 12. In order to secure the membrane 16 and the insulation 14 to the roof decking 10, a plurality of plastic or metal plates or washers 18 are disposed atop the membrane 16 at longitudinally spaced positions therealong, and suitable screw fasteners 20 or the like are driven through the plates or washers 18. The roofing system is completed by means of another membrane 22 disposed atop the insulation 14 and the membrane 16, the membrane 22 being glued or adhesively bonded to the underlying membrane 16, and is also secured to the upstanding perimeter wall 12 by means of a termination bar 24 which is fixedly mounted upon the wall 12 by means of a plurality of fasteners 26.

The foregoing system exhibits several structural deficiencies which lead to a deterioration of the system over a period of time subsequent to its installation. For example, installation specifications may mandate that the plate or washer and fastener assemblies 18,20 be positioned at predetermined locations along the longitudinal extent of the membrane 16 such that the assemblies 18, 20 are equidistant with respect to each other and are also located a predetermined distance from the wall 12, however, installation time constraints, deadlines, or the like, as well as the inexperience of some of the installation workmen, can lead to installation of the washer and fastener assemblies 18,20 at arrayed positions which do not conform to the specifications. In addition, wind blowing over the roof will create shear forces which will be effective upon the membranes 16,22 in the directions schematically illustrated by means of the arrows A. Since the upper or outer membrane 22 is adhesively bonded to the lower or inner membrane 16, and since the lower or inner membrane 16 is secured to the roof decking 10 by means of the washer and fastener assemblies 18,20, the membrane assembly 16,22 will be pulled and moved with respect to the fastener and washer assemblies 18,20 in a manner schematically illustrated by means of the dotted lines extending between the washer and fastener assemblies 18,20 as shown in FIG. 1. These shearing forces are, in turn, resisted by means of forces which are concentrated at the washer and fastener assemblies 18,20, and over an extended period of time, enlargement of the holes about the fasteners 20 tends to occur whereby water leakage and separation of the membrane 22 with respect to the wall 12 inevitably results.

In order to overcome the aforenoted deficiencies, disadvantages, and drawbacks of the prior art or conventional roofing system as noted hereinabove and as illustrated in FIG. 1, the parent patent application and patent were directed toward the roofing system disclosed within FIGS. 2 and 3. In accordance with such invention, a composite, pre-assembled roofing perimeter securing element, generally indicated by the reference character 28, comprises an elastomeric perimeter membrane 30, similar to the membrane 16, and a plastic batten strip 32. The composite element 28 can be rolled into a coil C for storage purposes, and can be uncoiled or unrolled upon the roofing structure when the same is to be used to secure the roofing insulation to the underlying decking 10. The membrane 30 may comprise a six-inch (6") wide strip of EPDM (ethylene propylene diene monomer) rubber approximately 0.045 inches thick, and the plastic batten strip 32 is preferably a flexible plastic strip one inch (1") wide, 0.050 inches thick, and manufactured in accordance with the formulation and method as set forth within U.S. Pat. No. 4,963,430, the disclosure of which is hereby incorporated herein by reference. As more particularly set forth within the noted U.S. Pat. No. 4,963,430, the composition of the batten strip may comprise 80–97% by weight polyethylene terephthalate, and 3–20% by weight of a polyolefin, wherein the polyolefin may be polypropylene.

In accordance with such disclosed invention, the batten strip is securely bonded along its longitduinal extent to the membrane 30 by means of a suitable adhesive 34. The batten strip 32 may be provided with pre-drilled or punched apertures 36 for the reception of suitable fasteners 38, or alternatively, the batten strip 32 may be simply marked at designated locations along its length whereby the holes or apertures 36 can be drilled therewithin when the composite element 28 is to be installed upon the roof. After installation of the composite element 28 upon the roofing structure by means of the fasteners 38, the roofing system is completed by means of the second or outer membrane 22 which may be secured to the underlying structure in a manner similar to that employed within FIG. 1, the completed roofing system of this disclosed invention being illustrated in FIG. 3. As can be readily appreciated, the noted invention comprises a significant improvement over the prior art or conventional system of FIG. 1 in that in view of the prefabrication of the composite element 28, the fasteners 38 are located at uniformly and properly spaced locations with respect to each other as well as with respect to the perimeter wall 12. In addition, in view of the provision and disposition of the batten strip 32 in connection with the membranes 30 and 22, resistance to the aforenoted shear loads or forces is maximized by distributing such loads or forces along the entire longitudinal length of the strip 32 and element 28 whereby, unlike the prior art system of FIG. 1, the loads or forces are not concentrated at the fasteners 38.

While the aforenoted roofing system of the parent patent application has proven to be quite satisfactory in connection with, for example, perimeter roofing fastener systems, such a composite roofing material fastening system would not be practical or applicable to a roofing system of the type wherein expansive membranes 18, in lieu of the limited width membrane 30, were employed, such as, for example, within a roofing system such as that disclosed within U.S. Pat. No. 5,242,736. Within such a system, the batten strips 32 could not be prefabricated along with the membrane 18, and consequently, if the batten strips 32 were to be adhesively bonded to the membrane 18 at the roofing site, the time required for the installation of such a roofing batten system would be significantly increased, and the operational or installation logistics would be quite cumbersome in view of the need to apply the adhesive bonding material to the individual batten strips 32 at the roofing site. In addition, provisions must be made to have an adequate supply of the adhesive bonding material present at the roofing site.

A need therefore exists in the art for a new and improved roofing batten which will permit roofing battens to be readily adhesively bonded to expansive roofing membranes at roofing installation sites without requiring separate supplies of adhesive bonding materials or the need to apply such adhesive bonding materials at the roofing installation sites.

OBJECTS OF THE INVENTION

It is therefore an object of the present invention to provide a new and improved roofing batten.

Another object of the present invention is to provide a new and improved roofing batten which can be readily attached to roofing membranes at roofing installation sites.

Yet another object of the present invention is to provide a new and improved roofing batten which can be readily adhesively bonded to expansive roofing membranes.

Still another object of the present invention is to provide a new and improved roofing batten which can be readily adhesively bonded to expansive roofing membranes at various different locations thereof as may be required or desired.

Yet still another object of the present invention is to provide a new and improved roofing batten which can be readily adhesively bonded to roofing membranes without requiring inordinate amounts of installation time and labor.

Still yet another object of the present invention is to provide a new and improved roofing batten which can be readily adhesively bonded to roofing membranes by means of a self-contained layer of adhesive bonding material whereby a separate supply of adhesive bonding materials, and the need to apply such adhesive bonding materials to the roofing battens at the roofing installation site, is obviated.

A further object of the present invention is to provide a new and improved roofing batten which can be readily adhesively bonded to roofing membranes by means of a self-contained layer of adhesive bonding material wherein the adhesive bonding material effectively forms a seal around the shank of the fastener securing the batten and roofing membrane to the underlying roofing deck structure so as to prevent water leakage downwardly toward the roofing insulation.

A yet further object of the present invention is to provide a new and improved roofing batten which can be readily adhesively bonded to roofing membranes by means of a self-contained layer of adhesive bonding material wherein the adhesive bonding material likewise effectively forms a seal around the hole formed with in the roofing membrane so as to prevent water leakage downwardly toward the roofing insulation.

A still further object of the present invention is to provide a new and improved roofing batten which can be readily adhesively bonded to roofing membranes by means of a self-contained layer of adhesive bonding material wherein the adhesive bonding material adhesively bonds the roofing batten and roofing membrane together such that relative movement between the roofing membrane and the roofing batten cannot occur thereby substantially increasing the windsplit resistance properties of the roofing membrane.

SUMMARY OF THE INVENTION

The foregoing and other objectives are achieved in accordance with the present invention through the provision of a new and improved roofing batten or batten strip which may be fabricated as a plastic batten strip which is essentially identical to the batten strip disclosed within the aforenoted U.S. Pat. No. 5,309,685, that is, the batten strip is preferably a flexible plastic strip one inch (1") wide, 0.050 inches thick, and manufactured in accordance with the formulation and method as set forth within U.S. Pat. No. 4,963,430. In addition, in accordance with the specific teachings and disclosure of the present invention, a suitable adhesive is provided or mounted upon the underside surface of the batten strip. The adhesive is disposed within a layer which is likewise approximately one inch (1") wide and 0.050 inches thick, and is inherently or naturally sticky or tacky at room temperature. A suitable adhesive composition comprises a butyl rubber compound fabricated in accordance with the teachings of U.S. Pat. No. 4,588,637 or U.S. Pat. No. 4,855,172. The adhesive is applied to the undersurface of the batten strip and is covered with a suitable release paper. The new and improved batten strip of the present invention therefore comprises an entirely self-contained composite batten strip which may be readily applied to the roofing membranes by simply removing the release paper backing strip. The adhesive, being inherently sticky or tacky along both major surfaces thereof, already has one major surface thereof disposed in contact with and adhered to the undersurface of the plastic batten strip, and the other or lower major surface of the adhesive layer is then able to be adhesively bonded to the roofing membrane once the paper backing strip is removed from the other or lower major surface of the adhesive layer thereby exposing the second, lower major surface of the adhesive layer.

The plastic batten strip may be preformed with holes or apertures uniformly spaced along the longitudinal extent thereof for the reception of suitable fasteners which may be inserted through the apertures or holes in order to secure composite batten strip and roofing membrane to underlying roofing structure or decking. Alternatively, the holes or apertures may be formed at the roofing site. In either case, it has been found that the adhesive layer provided upon the undersurface of the plastic batten strip also serves additional significant functions aside from simply securing the plastic batten strip to the underlying roofing membrane. The adhesive layer provides a peripheral seal around the shank portion of each fastener passing through the plastic batten strip, the adhesive layer, and the underlying roofing membrane, and similarly provides a peripheral seal around the hole or aperture formed within the underlying roofing membrane. Still further, the adhesive bonding layer bonds the plastic batten strip and roofing membrane together such that relative movement between the roofing membrane and the composite batten strip cannot occur thereby substantially increasing the windsplit resistance properties of the roofing membrane.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
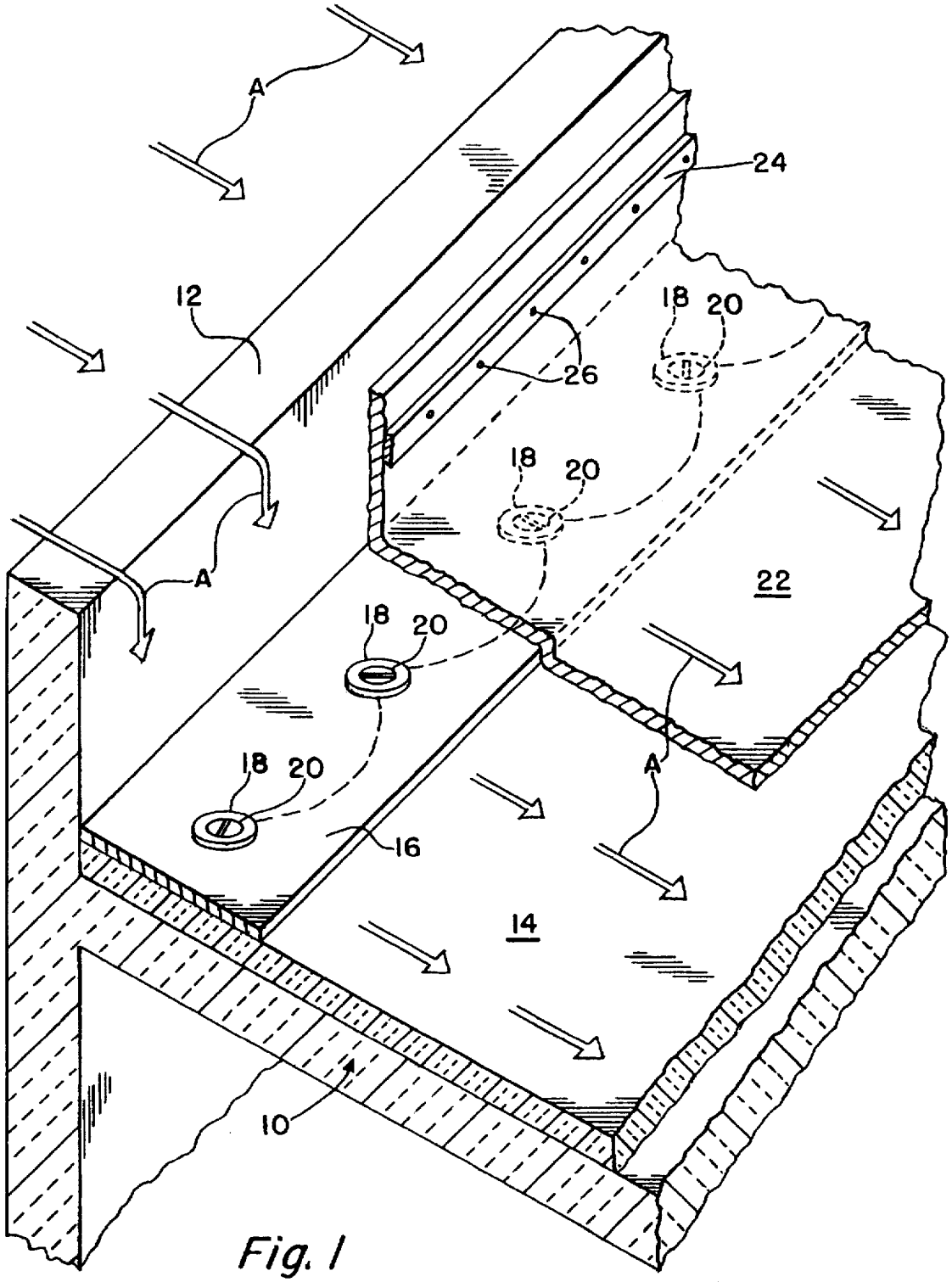
Fig. 1 (Prior Art)
FIG. 1 is a fragmentary perspective view of a PRIOR ART roofing system for securing perimeter membranes to underlying roofing structure.
Figures 2, 3:
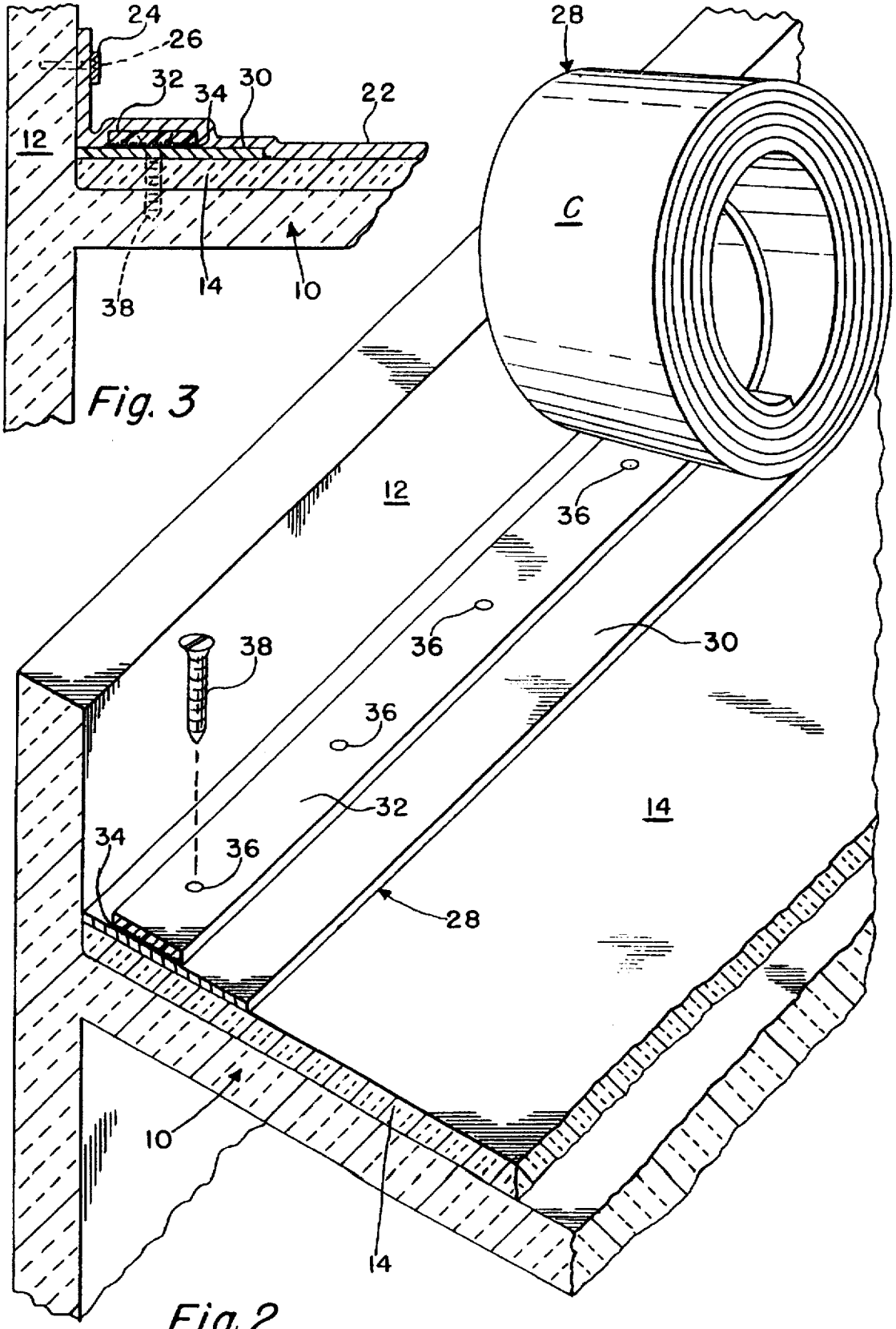
FIG. 2 is a fragmentary perspective view of an improved roofing system for securing perimeter membranes to underlying roofing structure.
FIG. 3 is a cross-sectional view of the completed perimeter roofing system of FIG. 2.
Figure 4:
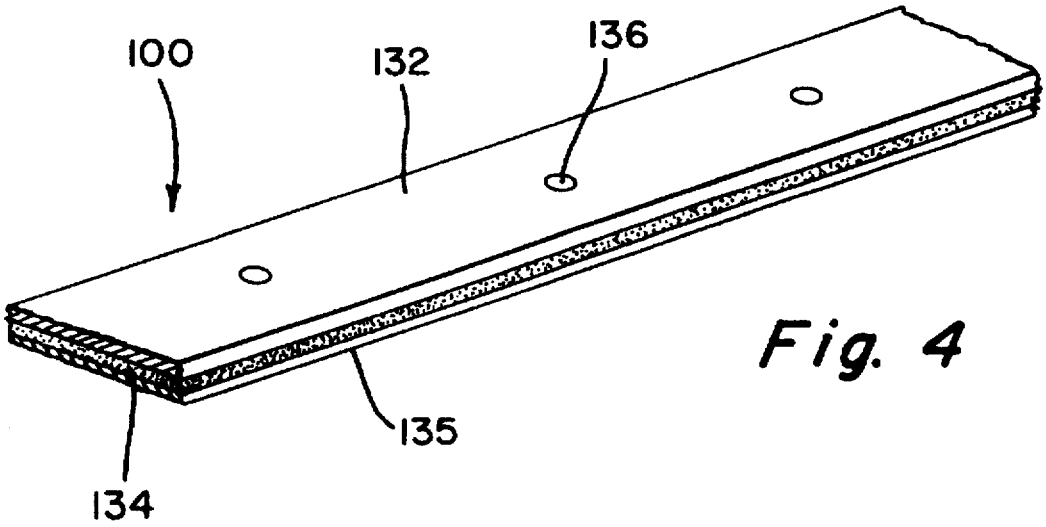
FIG. 4 is a fragmentary perspective view of the new and improved self-contained composite roofing batten strip constructed in accordance with the principles of the present invention.

Referring again to the drawings, and more particularly to FIG. 4 thereof, there is shown the new and improved self-contained composite roofing batten strip constructed in accordance with the principles of the present invention and generally indicated by the reference character 100. The self-contained composite roofing batten strip 100 is seen to comprise, briefly, an upper or outer roofing batten strip or bar 132, an adhesive layer 134 secured to the lower or undersurface portion of the batten strip or bar 132, and a releasable or removable paper backing strip 135.

Figure 5:
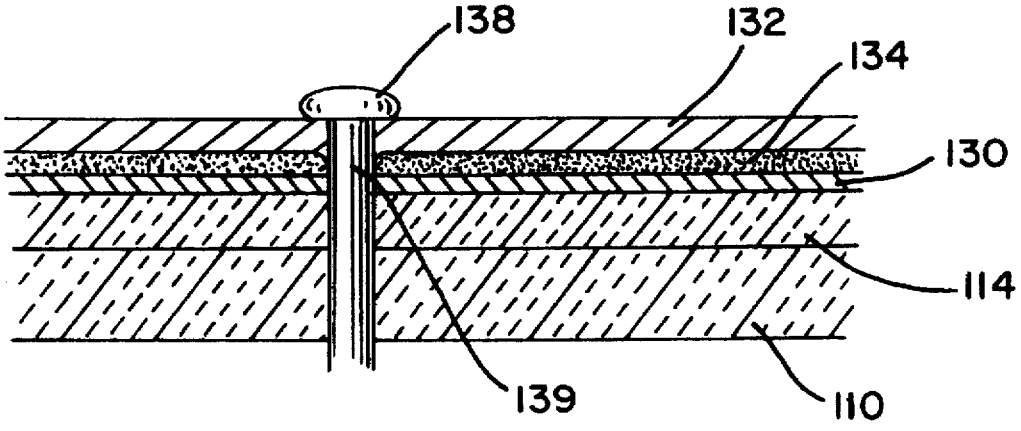
FIG. 5 is a cross-sectional view of the new and improved self-contained composite roofing batten strip of FIG. 4 as applied to a roofing membrane for securing the membrane and underlying roofing insulation to roofing structure or decking.

The batten strip or bar 132 is preferably a flexible plastic strip one inch (1") wide, 0.050 inches thick, and manufactured in accordance with the formulation and method as set forth more particularly within U.S. Pat. No. 4,963,430. As more particularly set forth within such patent, the composition of the batten strip or bar may comprise 80–97% by weight polyethylene terephthalate, and 3–20% by weight of a polyolefin, wherein the polyolefin may be, for example, polypropylene. The batten strip or bar 132 may be provided with pre-drilled or pre-punched holes or apertures 136 for the reception of suitable fasteners 138 which thereby secure the batten strip or bar 132, as well as a roofing membrane 130 and underlying roofing insulation 114 to a roofing substructure or decking 110, as best seen in FIG. 5. Alternatively, the holes or apertures 136 can be formed within the batten bar or strip 132 at the roofing site.

The roofing membrane 130 may comprise sheet material formed from EPDM (ethylene propylene diene monomer) rubber, wherein the sheeting is approximately 0.045 inches thick, and the adhesive layer 134 has dimensional characteristics which are similar to those of the batten bar or strip 132. More particularly, the adhesive layer 34 is approximately one inch (1") wide so that the side edge portions thereof do not protrude substantially outwardly beyond the side edge portions of the batten bar or strip 132, and the adhesive layer 134 also has a thickness which is approximately 0.050 inches. The adhesive is preferably fabricated from a suitable adhesive composition which is inherently or naturally sticky or tacky at room temperature, and the adhesive composition may comprise a butyl rubber compound fabricated in accordance with the teachings of U.S. Pat. No. 4,588,637 or U.S. Pat. No. 4,855,172. The adhesive composition is applied to the under-surface of the batten strip or bar 132 so as to comprise the adhesive layer 134, the composition being readily adherent to the batten strip or bar 132 due to its inherent or natural stickiness or tackiness. The outer or lower surface portion of the adhesive layer 134 is therefore likewise sticky or tacky, and consequently, in order to preserve such inherent or natural tackiness or stickiness of the composition until such time that the batten strip or bar 132, with its adhesive layer 134 already adhered thereto so as to comprise, in effect, a self-contained batten bar or strip, is to be secured atop the roofing membrane 130 and roofing insulation 114 in order to secure such roofing components to the underlying roofing structure or decking 110, the outer or lower surface portion of the adhesive layer 134 is covered by means of a suitable release paper type backing strip 135. The various elements comprising the batten strip or bar 132, the adhesive layer 134 adhered to the undersurface of the batten strip or bar 132, and the releasable paper backing strip 135 thus comprise and form the new and improved self-contained composite roofing batten strip or bar 100 of the present invention.

When the composite roofing batten strip or bar 100 is to be used to secure a roofing membrane 130 and a slab of roofing insulation 114 to an underlying roofing substructure, substrate, or decking 110, the releasable paper backing strip 135 is removed from the outer or lower surface of the adhesive layer 134 whereby the outer or lower surface of the adhesive layer 134 is exposed. Consequently, the batten strip or bar 132, with the exposed adhesive layer 134 disposed thereon, can be applied atop the roofing membrane 130 and adhered thereto at predetermined roofing sites or locations. Fasteners 138 can then be inserted through the batten strip or bar 132, the adhesive layer 134, roofing membrane 130, and roofing insulation 114 and fixedly engaged within the underlying roofing structure or decking 110 so as to fixedly secure the roofing membrane 130 and the roofing insulation 114 to the roofing deck or structure 110.

As may be appreciated from FIG. 5 of the drawings, and in view of the fact that the adhesive layer 134 is not only tacky or sticky but extremely or highly viscous and somewhat deformable, when the fasteners 138 are inserted within and through the holes or apertures 136 of the batten strip or bar 132 so as to be fixedly installed within the roofing substructure or decking 110, the adhesive layer 134 readily forms a peripheral seal about the shank portion 139 of each fastener 138. This peripheral seal effectively prevents the ingress of water, such as, for example, as may occur from dew condensation, rain, melting snow or ice, and the like, whereby such water cannot flow downwardly toward, and ultimately degrade, the roofing insulation 114. Similarly, the adhesive layer 134 also provides similar sealing around the aperture or hole formed within the roofing membrane 130 and also serves to reinforce such aperture or hole to a predetermined degree whereby enlargement of such aperture or hole with respect to the shank portion 139 of the fastener 138 is effectively prevented. Still further, since the adhesive layer 134 has both of its upper and lower major surfaces adhesively bonded to the batten strip or bar 132 and the roofing membrane 130 respectively, the roofing membrane is effectively fixed with respect to the batten bar or strip 132. Consequently, relative movement between the batten bar or strip 132 and the roofing membrane 130 cannot occur which substantially increases the windsplit resistance properties of the roofing membrane 130.

It is to be further appreciated that as a result of the particular structure of the self-contained composite batten strip or bar 100 of the present invention and its adherence to the underlying roofing membrane 130, as well as the fixation of the batten strip-roofing membrane assembly to or upon the roofing substructure or decking 110, shear forces generated by blowing winds have a minimal effect upon the assembly, and particularly upon the roofing membrane 130, due to the fact that resistance to such shear forces or loads is maximized by the fact that such forces or loads are distributed along the entire longitudinal length of the batten strip or bar 132 and not concentrated at the locations of the fasteners 138.

Thus it may be seen that the self-contained composite roofing batten strip or bar of the present invention comprises a new and improved batten strip or bar as compared with the known or prior art batten strips or bars. In particular, the present invention comprises a self-contained composite roofing batten strip or bar which has its own adhesive strip or layer integrally mounted upon the lower surface thereof such that the self-contained roofing batten is immediately available and ready for installation upon the roofing structure simply by removing the releasable paper backing strip. No additional supplies of adhesive are required at the roofing site, and no additional adhesive application operations are required at the roofing site. Consequently, significant installation time and labor costs are saved. In addition, equipment handling logistics are significantly simplified in that only a single supply of the self-contained batten strips need be provided or transported to the roofing jobsite in lieu of separate supplies of batten strips, adhesive, and accessory equipment for coating the batten strips with the adhesive material.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by Letters Patent of the United States is:

1. In combination, a system for readily facilitating the securing of a roofing component to underlying roofing decking, comprising:

a roofing membrane to be secured to underlying roofing decking; and a self-contained composite roofing batten strip comprising a roofing batten strip having upper and lower longitudinally extending surface portions having a predetermined length; a strip of adhesive, which is inherently tacky at room temperature, having a predetermined length which is substantially the same as said predetermined length of said roofing batten strip, and having upper and lower longitudinally extending surface portions with said upper longitudinally extending surface portion adhesively secured to said lower longitudinally extending surface portion of said roofing batten strip; and a releasable backing strip, having a predetermined length which is substantially the same as said predetermined length of said strip of adhesive as well as said predetermined length of said roofing batten strip, releasably bonded to said lower longitudinally extending surface portion of said strip of adhesive whereupon removal of said releasable backing strip from said lower surface portion of said strip of adhesive and contact of said lower surface portion of said strip of adhesive with said roofing membrane, said roofing batten strip is adhesively bonded to said roofing membrane whereby said roofing membrane is able to be secured to underlying roofing decking by said self-contained composite roofing batten strip.

2. The combination as set forth in claim 1, wherein:

said roofing batten strip is approximately one inch (1") wide and 0.050 inches thick.

3. The combination as set forth in claim 1, wherein:

said roofing batten strip is fabricated as a composition comprising 80–97% by weight polyethylene terephthalate, and 3–20% by weight of a polyolefin.

4. The combination as set forth in claim 3, wherein:

said polyolefin is polypropylene.

5. The combination as set forth in claim 1, wherein:

said strip of adhesive comprises a butyl rubber compound.

6. The combination as set forth in claim 1, wherein:

said strip of adhesive is approximately one inch (1") wide and 0.050 inches thick.

7. The combination as set forth in claim 1, wherein:

aperture means are preformed within said roofing batten strip for subsequently receiving fasteners for securing said roofing batten strip, having said strip of adhesive adhesively secured to said lower surface portion of said roofing batten strip, and said roofing membrane adhesively bonded to said strip of adhesive, to said underlying roofing decking.

8. In combination, a system for readily facilitating the securing of a roofing component to underlying roofing structure, comprising:

a roofing membrane to be secured to underlying roofing structure; and a self-contained composite roofing batten bar, adapted to be rolled into a roll of roofing batten bar material which may be unrolled when readied for installation upon underlying roofing structure, comprising a roofing batten bar having upper and lower longitudinally extending surface portions having a predetermined length; an adhesive strip, which is naturally sticky at room temperature, having a predetermined length which is substantially the same as said predetermined length of said roofing batten bar, and upper and lower longitudinally extending surface portions with said upper longitudinally extending surface portion adhesively bonded to said lower longitudinally extending surface portion of said roofing batten bar; and a releasable backing strip, having a predetermined length which is substantially the same as said predetermined length of said adhesive strip as well as said predetermined length of said roofing batten bar, releasably bonded to said lower longitudinally extending surface portion of said adhesive strip whereupon removal of said releasable backing strip from said lower surface portion of said adhesive strip, after a portion of said composite roofing batten bar has been unrolled from said roll of roofing batten bar material, and contact of said lower surface portion of said adhesive strip has been made with said roofing membrane, said roofing batten bar, having said adhesive strip adhesively bonded thereto, is adhesively bonded to said roofing membrane whereby said roofing membrane is able to be secured to underlying roofing decking by said self-contained composite roofing batten bar.

9. The combination as set forth in claim 8, wherein:

said roofing batten bar is approximately one inch (1") in width and has a thickness dimension of approximately 0.050 inches.

10. The combination as set forth in claim 8, wherein:

said roofing batten bar is fabricated as a composition comprising 80–97% by weight polyethylene terephthalate, and 3–20% by weight of a polyolefin.

11. The combination as set forth in claim 10, wherein:

said polyolefin comprises polypropylene.

12. The combination as set forth in claim 8, wherein:

said adhesive strip comprises a butyl rubber compound.

13. The combination as set forth in claim 8, wherein:

said adhesive strip if approximately one inch "1") wide and 0.050 inches thick.

14. The combination as set forth in claim 8, wherein:

aperture means are preformed within said roofing batten bar at longitudinally spaced locations along said longitudinal extent of said roofing batten bar for receiving fasteners for securing said roofing batten bar, having said adhesive strip adhesively bonded to said lower surface of said roofing batten bar, and said roofing membrane adhesively bonded to said adhesive strip, to said underlying roofing structure.

15. In combination, a system for readily facilitating the securing of a roofing component to underlying roofing insulation and decking structure, comprising:

a roofing membrane to be secured to underlying roofing insulation and decking structure; and a self-contained composite roofing batten strip comprising a roofing batten strip having upper and lower longitudinally extending surface portions extending along a longitudinal extent of said roofing batten strip and having a predetermined length; an adhesive strip, which is inherently tacky at room temperature, having a predetermined length which is substantially the same as said predetermined length of said roofing batten strip, and upper and lower longitudinally extending surface portions extending along a longitudinal extent of said adhesive strip wherein said upper longitudinally extending surface portion thereof is adhesively bonded to said lower longitudinally extending surface portion of said roofing batten strip; and a releasable backing strip, having a predetermined length which is substantially the same as said predetermined length of said roofing batten strip as well as said predetermined length of said adhesive strip, releasably bonded to said lower longitudinally extending surface portion of said adhesive strip whereupon removal of said releasable backing strip from said lower surface portion of said adhesive strip and contact of said lower surface portion of said adhesive strip with said roofing membrane, said roofing batten strip is adhesively bonded to said roofing membrane by means of said adhesive strip whereby said roofing membrane is able to be secured to underlying roofing insulation and decking structure by said self-contained composite roofing batten strip.

16. The combination as set forth in claim 15, wherein:

said roofing batten strip, and said adhesive strip, are both approximately one inch (1") wide and 0.050 inches thick.

17. The combination as set forth in claim 15, wherein:

said roofing batten strip is fabricated as a composition comprising 80–97% by weight polyethylene terephthalate, and 3–20% by weight of a polyolefin.

18. The combination as set forth in claim 17, wherein:

said polyolefin comprises polypropylene.

19. The combination as set forth in claim 15, wherein:

said adhesive strip comprises a butyl rubber compound.

20. The combination as set forth in claim 15, wherein:

aperture means are preformed within said roofing batten strip for subsequently receiving fasteners for securing said roofing batten strip, having said adhesive strip adhesively bonded to said lower surface portion of said roofing batten strip, and said roofing membrane to said underlying roofing insulation and decking structure.

* * * * *